US010760017B2

(12) United States Patent
Schmitz-Goeb et al.

(10) Patent No.: US 10,760,017 B2
(45) Date of Patent: Sep. 1, 2020

(54) GASIFICATION SYSTEM AND PROCESS

(71) Applicant: Air Products and Chemicals, Inc., Allentown, PA (US)

(72) Inventors: Manfred Heinrich Schmitz-Goeb, Gummersbach (DE); Paul Christian Karzel, Bremen (DE)

(73) Assignee: Air Products & Chemicals, Inc., Allentown, PA (US)

( * ) Notice: Subject to any disclaimer, the term of this patent is extended or adjusted under 35 U.S.C. 154(b) by 9 days.

(21) Appl. No.: 16/062,331

(22) PCT Filed: Dec. 15, 2016

(86) PCT No.: PCT/EP2016/081185
§ 371 (c)(1),
(2) Date: Jun. 14, 2018

(87) PCT Pub. No.: WO2017/102942
PCT Pub. Date: Jun. 22, 2017

(65) Prior Publication Data

US 2018/0371341 A1 Dec. 27, 2018

(30) Foreign Application Priority Data

Dec. 16, 2015 (EP) ..... 15200400

(51) Int. Cl.
*C10J 3/84* (2006.01)
*C10J 3/00* (2006.01)
(Continued)

(52) U.S. Cl.
CPC ..... *C10J 3/845* (2013.01); *C10J 3/002* (2013.01); *C10J 3/74* (2013.01); *C10J 3/78* (2013.01);
(Continued)

(58) Field of Classification Search
CPC ..... C10J 3/845; C10J 3/74; C10J 3/002; C10J 3/52
See application file for complete search history.

(56) References Cited

U.S. PATENT DOCUMENTS 4,443,230 A 4/1984 Stellaccio
4,491,456 A 1/1985 Schlinger
(Continued)

FOREIGN PATENT DOCUMENTS

KR 1020090121379 11/2009
WO 1995032148 11/1995
(Continued)

OTHER PUBLICATIONS

European International Search Report and Written Opinion of the International Searching Authority, dated Mar. 13, 2017, for PCT/EP2016/081185.

*Primary Examiner* — Matthew J Merkling
(74) *Attorney, Agent, or Firm* — Amy Carr-Trexler

(57) ABSTRACT

A gasification system for the partial oxidation of a carbonaceous feedstock to at least provide a synthesis gas, comprising: a reactor chamber for receiving and partially oxidizing the carbonaceous feedstock; a quench chamber below the floor of the reactor chamber for holding a bath of liquid coolant; an intermediate section at said reactor chamber floor, the intermediate section having a reactor outlet opening through which the reactor chamber communicates with the quench chamber to conduct the synthesis gas from the reactor chamber into the bath of the quench chamber; at least one layer of refractory bricks arranged on and supported by the reactor chamber floor, the lower end section of the refractory bricks enclosing the reactor outlet opening and defining the inner diameter thereof; and a dip tube extending
(Continued)

from the reactor outlet opening to the bath of the quench chamber, the dip tube having a widened top section.

18 Claims, 6 Drawing Sheets

(51) Int. Cl.
*C10J 3/74* (2006.01)
*C10J 3/78* (2006.01)

(52) U.S. Cl.
CPC .... *C10J 2200/09* (2013.01); *C10J 2300/1846* (2013.01)

(56) References Cited

U.S. PATENT DOCUMENTS

| | | | | |
|---|---|---|---|---|
| 4,801,307 | A | 1/1989 | Muenger et al. | |
| 4,828,578 | A | 5/1989 | Den Bleyker | |
| 4,919,688 | A | 4/1990 | Suggitt | |
| 5,464,592 | A | 11/1995 | Brooker et al. | |
| 7,141,085 | B2 | 11/2006 | Groen et al. | |
| 9,032,623 | B2 | 5/2015 | Boer et al. | |
| 9,127,222 | B2 | 9/2015 | Bhattacharya et al. | |
| 2009/0047193 | A1* | 2/2009 | Corry | C10J 3/06 422/200 |
| 2009/0202403 | A1 | 8/2009 | Jimenz-Huyke | |
| 2010/0263841 | A1* | 10/2010 | Corry | C10J 3/86 165/133 |
| 2010/0325957 | A1 | 12/2010 | Klockow et al. | |
| 2011/0067304 | A1* | 3/2011 | Klockow | B01D 47/021 48/87 |
| 2011/0120009 | A1 | 5/2011 | Klockow et al. | |
| 2011/0120010 | A1 | 5/2011 | Tiwari et al. | |
| 2015/0218471 | A1 | 8/2015 | Hannemann et al. | |

FOREIGN PATENT DOCUMENTS

| | | |
|---|---|---|
| WO | 2008110592 | 9/2008 |
| WO | 2012101194 A1 | 8/2012 |

* cited by examiner

GASIFICATION SYSTEM AND PROCESS

BACKGROUND OF THE INVENTION

The invention relates to a gasification system and a process for the production of synthesis gas by partial combustion of a carbonaceous feed.

The carbonaceous feed can for instance comprise pulverized coal, biomass, (heavy) oil, crude oil residue, bio-oil, hydrocarbon gas or any other type of carbonaceous feed or mixture thereof.

Syngas, or synthesis gas, as used herein is a gas mixture comprising hydrogen, carbon monoxide, and potentially some carbon dioxide. The syngas can be used, for instance, as a fuel, or as an intermediary in creating synthetic natural gas (SNG) and for producing ammonia, methanol, hydrogen, waxes, synthetic hydrocarbon fuels or oil products, or as a feedstock for other chemical processes.

The disclosure is directed to a system comprising a gasification reactor for preparing syngas, and a quench chamber for receiving the syngas from the reactor. A syngas outlet of the reactor is fluidly connected with the quench chamber via a tubular diptube. Partial oxidation gasifiers of the type shown in, for instance, U.S. Pat. Nos. 4,828,578 and 5,464,592, include a high temperature reaction chamber surrounded by one or more layers of insulating and refractory material, such as fire clay brick, also referred to as refractory brick or refractory lining, and encased by an outer steel shell or vessel.

A process for the partial oxidation of a liquid, hydrocarbon-containing fuel, as described in WO9532148A1, can be used with the gasifier of the type shown in the patent referenced above. A burner, such as disclosed in U.S. Pat. Nos. 9,032,623, 4,443,230 and 4,491,456, can be used with gasifiers of the type shown in the previously referred to patent to introduce liquid hydrocarbon containing fuel, together with oxygen and potentially also a moderator gas, downwardly or laterally into the reaction chamber of the gasifier.

As the fuel reacts within the gasifier, one of the reaction products may be gaseous hydrogen sulfide, a corrosive agent. Molten or liquid slag may also be formed during the gasification process, as a by-product of the reaction between the fuel and the oxygen containing gas. The reaction products and the amount of slag may depend on the type of fuel used. Fuels comprising coal will typically produce more slag than liquid hydrocarbon comprising fuel, for instance comprising heavy oil residue. For liquid fuels, corrosion by corrosive agents and the elevated temperature of the syngas is more prominent.

Slag is also a well known corrosive agent and gradually flows downwardly along the inside walls of the gasifier to a water bath. The water bath cools the syngas exiting from the reaction chamber and also cools any slag that drops into the water bath.

Before the downflowing syngas reaches the water bath, it flows through an intermediate section at a floor portion of the gassification reactor and through the dip tube that leads to the water bath.

The gasifier as described above typically also has a quench ring. A quench ring may be formed of a corrosion resistant material, such as chrome nickel iron alloy or nickel based alloy such as Incoloy®, and is arranged to spray or inject water as a coolant against the inner surface of the dip tube. The gasifiers of U.S. Pat. No. 4,828,578 and U.S. Pat. No. 5,464,592 are intended for a liquid fuel comprising a slurry of coal and water, which will produce slag. Some portions of the quench ring are in the flow path of the downflowing molten slag, and the quench ring can thus be contacted by molten slag. The portions of the quench ring that are contacted by slag may experience temperatures of approximately 1800° F. to 2800° F. (980 to 1540° C.). The prior art quench ring thus is vulnerable to thermal damage and thermal chemical degradation. Depending on the feedstock, slag may also solidify on the quench ring and accumulate to form a plug that can restrict or eventually close the syngas opening. Furthermore any slag accumulation on the quench ring will reduce the ability of the quench ring to perform its cooling function.

In one known gasifier the metal floor portion of the reaction chamber is in the form of a frustum of an upside down conical shell. The metal floor may be made of the same pressure vessel metallurgy as the gasifier shell or vessel. The intermediate section may comprise a throat structure at a central syngas outlet opening in the gasifier floor.

The metal gasifier floor supports refractory material such as ceramic brick, that covers the metal floor, and also supports the refractory material that covers the inner surface of the gasifier vessel above the gasifier floor. The gasifier floor can also support the underlying quench ring and dip tube.

A peripheral edge of the gasifier floor at the intermediate section, also know as a leading edge, may be exposed to the harsh conditions of high temperature, high velocity syngas (which may have entrained particles of erosive ash, depending on the nature of the feedstock) and slag. Herein, the amount of slag may also depend on the nature of the feedstock.

In a prior art gasification system, the metal floor suffered wastage in a radial direction (from the center axis of the gasifier), beginning at the leading edge and progressing radially outward until the harsh conditions created by the hot syngas are in equilibrium with the cooling effects of the underlying quench ring. The metal wasting action thus progresses radially outward from a center axis of the gasifier until it reaches an "equilibrium" point or "equilibrium" radius.

The equilibrium radius is occasionally far enough from the center axis of the gasifier and the leading edge of the floor such that there is a risk that the floor can no longer sustain the overlying refractory. If refractory support is in jeopardy, the gasifier may require premature shut down for reconstructive work on the floor and replacement of the throat refractory, a very time intensive and laborious procedure.

Another problem at the intermediate section or throat section of the prior art gasifier is that the upper, curved surface of the quench ring is exposed to full radiant heat from the reaction chamber of the gasifier, and the corrosive and/or erosive effects of the high velocity, high temperature syngas which can include ash and slag. Such harsh conditions can also lead to wastage problems of the quench ring which, if severe enough, can force termination of gasification operations for necessary repair work. This problem is exacerbated if the overlying floor has wasted away significantly, exposing more of the quench ring to the hot gas and slag.

It was reported that the above described design had experienced frequent failures such as wearing off and corrosion of the refractory bricks, metal floor and the quench ring. The throat section, i.e. the interface between the reactor and the quench section, may have the following problems:

the metal supporting structure at the bottom of the intermediate section and reactor outlet is vulnerable to wear caused by the high temperature and corrosive hot gas;

the interface between the hot dry reactor and the wet quench area is vulnerable to fouling; and the quench ring has a risk of overheating by hot syngas.

U.S. Pat. No. 4,801,307 discloses a refractory lining, wherein a rear portion of the flat underside of the refractory lining at the downstream end of the central passage is supported by the quench ring cover while a front portion of the refractory lining overhangs the vertical leg portion of the quench ring face and cover. The overhang slopes downward at an angle in the range of about 10 to 30 degrees. The overhang provides the inside face with shielding from the hot gas. A refractory protective ring may be fixed to the front of an inside face of the quench ring.

U.S. Pat. No. 7,141,085 discloses a gasifier having a throat section and a metal floor with a throat opening at the throat section, the throat opening in the metal floor being defined by an inner peripheral edge of the metal gasifier floor. The metal gasifier floor has an overlying refractory material, and a hanging refractory brick at the inner peripheral edge of the metal floor having a bottom portion including an appendage, the appendage having a vertical extent being selected to overhang a portion of the inner peripheral edge of the metal gasifier floor. A quench ring underlies the gasifier floor at the inner peripheral edge of the gasifier floor, the appendage being sufficiently long to overhang the upper surface of the quench ring.

U.S. Pat. No. 9,057,030 discloses a gasification system having a quench ring protection system comprising a protective barrier disposed within the inner circumferential surface of the quench ring. The quench ring protection system comprises a drip edge configured to locate dripping molten slag away from the quench ring, and the protective barrier overlaps the inner circumferential surface along greater than approximately 50 percent of a portion of an axial dimension in an axial direction along an axis of the quench ring, and the protective barrier comprises a refractory material.

U.S. Pat. No. 9,127,222 discloses a shielding gas system to protect the quench ring and the transition area between the reactor and the bottom quench section. The quench ring is located below the horizontal section of the metal floor of the gasification reactor.

According to patent literature, one of the most common corrosion spots is at the front of the quench ring, which is the device that injects a film of water on the inside of the dip tube at the point where the refractory ends. The quench ring is not only directly exposed to the hot syngas, but may also suffer from insufficient cooling when gas collects in the top, and thermal overload and/or corrosion can occur.

Long term operation of the prior art designs described above has indicated a few issues. For instance, the designs protect the metal floor by refractory layers from the hot face side, yet the hot syngas can still ingress through the joints of the refractory brick and eventually reach the metal floor. The refractory brick may be eroded or worn off, in which case the protection of the metal floor will be lost. In addition, although the overhanging brick of the prior art is meant to protect the quench ring, the risk of overheating the quench ring is still relatively high as the brick, and its overhanging section, may be eroded. Industry has reported damages and cracks at the quench ring even with overhanging bricks. Finally, the syngas from the reactor typically contains soot and ash particles, which may stick on dry surface and start accumulating, for instance on the quench ring. The soot and ash accumulation at the quench ring may block the water distributor outlet of the quench ring. Once the water distribution of the quench ring is disturbed, the dip tube can experience dry spots and resulting overheating, resulting again in damage to the diptube.

In addition, the material of the dip tube is protected with a water film on the inner surface of the dip tube, which prevents the buildup of deposits and cools the wall of the dip tube. Inside the dip tube, severe corrosion may occur in case wall sections of the dip tube are improperly cooled or experience alternating wet-dry cycles.

BRIEF DESCRIPTION OF THE INVENTION

It is an object of the disclosure to provide an improved gasification system and method, obviating at least one of the problems described above.

The invention provides a gasification system for the partial oxidation of a carbonaceous feedstock to at least provide a synthesis gas, the system comprising:

a reactor chamber for receiving and partially oxidizing the carbonaceous feedstock;

a quench chamber below the reactor chamber for holding a bath of liquid coolant; and an intermediate section connecting the reactor chamber to the quench chamber, the intermediate section comprising:

a reactor chamber floor provided with a reactor outlet opening through which the reactor chamber communicates with the quench chamber to conduct the synthesis gas from the reactor chamber into the bath of the quench section-quench chamber;

at least one layer of refractory bricks arranged on and supported by the reactor chamber floor, the refractory bricks enclosing the reactor outlet opening;

the system further comprising a dip tube extending from the reactor outlet opening to the bath of the quench chamber, the dip tube having a widened top section.

In an embodiment, the widened top section of the dip tube encloses an outer surface of the reactor outlet opening.

The widened top section of the dip tube may be provided with a quench ring for providing liquid coolant to the inner surface of the dip tube. A lower end of the quench ring may be arranged at a distance above a lower end of the reactor outlet opening. For instance, the quench ring can be arranged at a horizontal distance with respect to the inner surface of the reactor outlet opening.

In an embodiment, the widened top section comprises a curved section.

Optionally, the reactor chamber floor comprises a conical section and a horizontal section connected to the conical section at an intersection; the widened top section of the dip tube defining a gap between the dip tube and the reactor chamber floor. A minimum distance of said gap can be located between a wall of the widened top section of the diptube and an intersection floor sections of the reactor chamber floor. The minimum distance may be limited to 5 cm or less.

In an embodiment, the gasification system comprises at least one blast nozzle directed to the gap between the dip tube and the reactor chamber floor for cleaning or purging thereof.

The dip tube may comprise a cylindrical middle section connected to the widened top section, the middle section having a dip tube inner diameter being substantially equal to an inner diameter of the reactor outlet opening. The middle section of the dip tube can be provided with a cooling enclosure on the outside of the middle section. The cooling enclosure may comprise a cylindrical element with closed upper end and closed lower end, leaving an annular space between the cylindrical element and the outer diameter of the middle dip tube section for circulating cooling fluid.

According to another aspect, the disclosure provides a gasification process for the partial oxidation of a carbonaceous feedstock to at least provide a synthesis gas, comprising the use of a gasification system according to claim 1.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The disclosed embodiments, discussed in detail below, are suitable for gasifier systems that include a reaction chamber that is configured to convert a feedstock into a synthetic gas, a quench chamber that is configured to cool the synthetic gas, and a quench ring that is configured to provide a water flow to the quench chamber. The synthetic gas passing from the reaction chamber to the quench chamber may be at a high temperature. Thus, in certain embodiments, the gasifier includes embodiments of an intermediate section, between the reactor and the quench chamber, that is configured to protect the quench ring or metal parts from the synthetic gas and/or molten slag that may be produced in the reaction chamber. The synthetic gas and molten slag may collectively be referred to as hot products of gasification. A gasification method may include gasifying a feedstock in the reaction chamber to generate the synthetic gas, and quenching the synthetic gas in the quench chamber to cool the synthetic gas.

Figure 1:
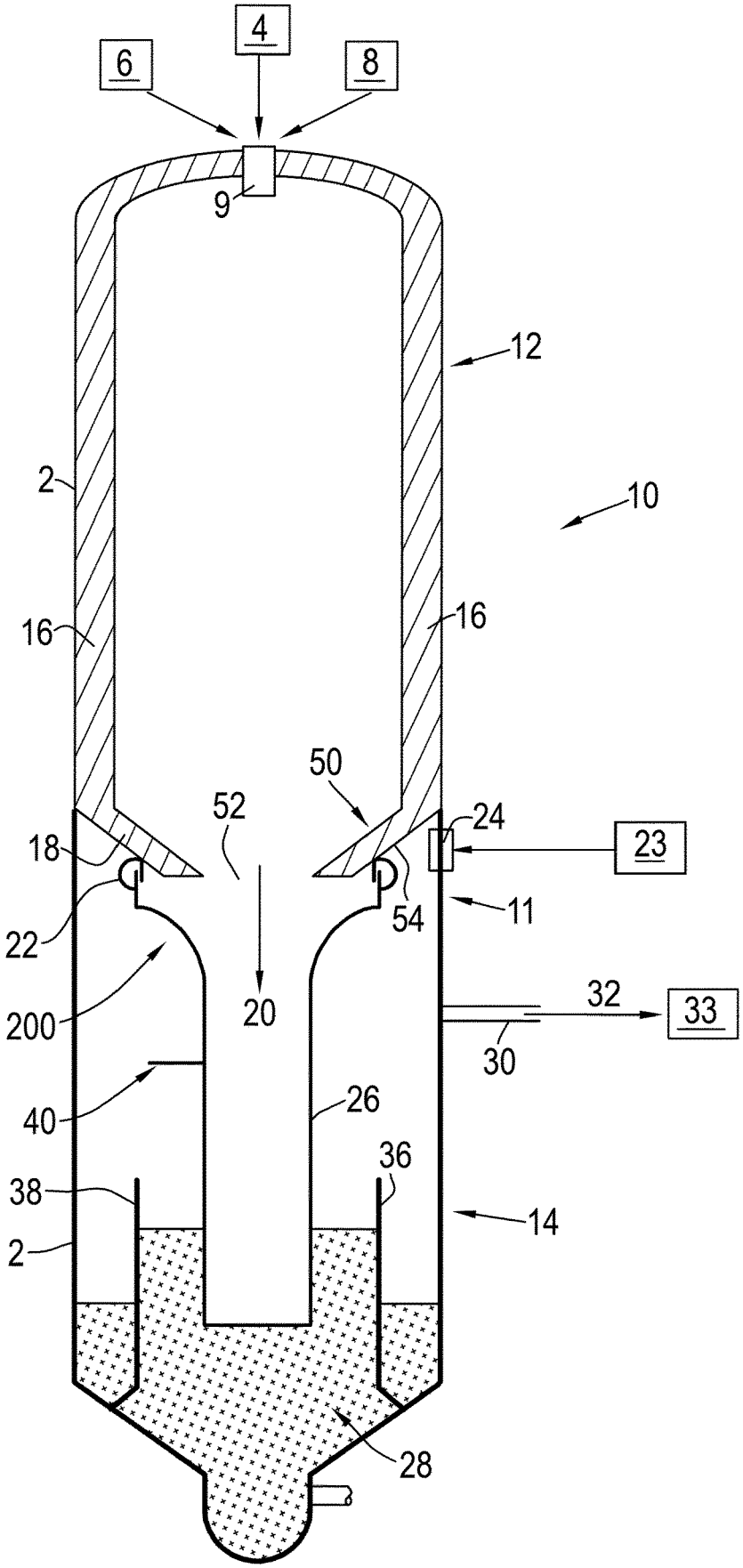
FIG. 1 shows a sectional view of an exemplary embodiment of a gasifier.

FIG. 1 shows a schematic diagram of an exemplary embodiment of a gasifier 10. An intermediate section 11 is arranged between a reaction chamber 12 and a quench chamber 14. A protective barrier 16 may define the reaction chamber 12. The protective barrier 16 may act as a physical barrier, a thermal barrier, a chemical barrier, or any combination thereof.

Examples of materials that may be used for the protective barrier 16 include, but are not limited to, refractory materials, refractory metals, non-metallic materials, clays, ceramics, cermets, and oxides of aluminum, silicon, magnesium, and calcium. In addition, the materials used for the protective barrier 16 may be bricks, castable, coatings, or any combination thereof. Herein, a refractory material is one that retains its strength at high temperatures. ASTM C71 defines refractory materials as "non-metallic materials having those chemical and physical properties that make them applicable for structures, or as components of systems, that are exposed to environments above 1,000° F. (538° C.)".

The reactor 12 and refractory cladding 16 may be enclosed by a protective shell 2. The shell is, for instance, made of steel. The shell 2 is preferably able to withstand, at least, the pressure difference between the designed operating pressure inside the reactor, and the pressure in the factory site, which is typically at atmospheric pressure, i.e. about 1 atmosphere. Herein, 1 standard atmosphere (atm) is equal to 101325 Pa or 14.696 psi.

A feedstock 4, along with oxygen 6 and an optional moderator 8, such as steam, may be introduced through one or more inlets into the reaction chamber 12 of the gasifier 10 to be converted into a raw or untreated synthetic gas, for instance, a combination of carbon monoxide (CO) and hydrogen (H2), which may also include slag and other contaminants. The inlets for feedstock, oxygen, and moderator may be combined in one or more burners 9. In the embodiment as shown, the gasifier is provided with a single burner 9 at the top end of the reactor. Additional burners may be included, for instance at the side of the reactor. In certain embodiments, air or oxygen-enhanced air may be used instead of the oxygen 6. Oxygen content of the oxygen-enhanced air may be in the range of 80 to 99%, for instance about 90 to 95%. The untreated synthesis gas may also be described as untreated gas.

The conversion in the gasifier 10 may be accomplished by subjecting the feedstock to steam and oxygen at elevated pressures, for instance, from approximately 20 bar to 100 bar, or 35 to 55 bar, and temperatures, for instance, approximately 1300 degrees C. to 1450 degrees C., depending on the type of gasifier 10 and feedstock utilized.

During operation of the gasifier, typical reaction chamber temperatures can range from approximately 2200° F. (1200° C.) to 3300° F. (1800° C.). For liquid fuels, the temperature in the reaction chamber may be around 1300 to 1500° C. Operating pressures can range from 10 to 200 atmospheres. For liquid fuels, the pressure may be in the range of 30 to 70 atmospheres. Thus, the hydrocarbon comprising fuel that passes through the burner nozzle normally self-ignites at the operating temperatures inside the gasification reactor.

Under these conditions, the slag is in the molten state and is referred to as molten slag. In other embodiments, the molten slag may not be entirely in the molten state. For example, the molten slag may include solid (non-molten) particles suspended in molten slag.

Liquid feedstock, such as heavy oil residue from refineries, may generate ash containing metal oxides. Particular wearing associated with liquid fuels, such as heavy oil residue, may include one of more of:

- erosion, as a result of high velocities in combination with hard particles such as metal oxides;
- sticky ash, as elements with a lower melting point can result in slagging;
- sulfidation, as relatively high sulfur content in the feedstock results in corrosion by sulfidation; and
- carbonyl formation, as Nickel (Ni) and iron (Fe) in the oil residue in the presence of CO may form $\{Ni(CO)_4 Fe(CO)_5\}$, which is insoluble in water and may therefore be carried over to gas treatment after quenching.

The high-pressure, high-temperature untreated synthetic gas from the reaction chamber 12 may enter a quench chamber 14 through a syngas opening 52 in a bottom end 18 of the protective barrier 16, as illustrated by arrow 20. The syngas opening is provided in a reactor chamber floor 50. The floor 50 may comprise a support section 54 provided with and supporting the protective barrier 16.

In general, the quench chamber 14 may be used to reduce the temperature of the untreated synthetic gas. In certain embodiments, a quench ring 22 may be located proximate to the bottom end 18 of the protective barrier 16. The quench ring 22 is configured to provide quench water to the quench chamber 14.

As illustrated, quench water 23, for instance recycled from a gas scrubber unit, may be received through a quench water inlet 24 into the quench chamber 14. In general, the quench water 23 may be provided to and flow through the quench ring 22 and down a dip tube 26 into a quench chamber sump 28. As such, the quench water 23 may cool the untreated synthetic gas, which may subsequently exit the quench chamber 14 through a synthetic gas outlet 30 after being cooled, as illustrated by arrow 32.

In other embodiments, a coaxial draft tube 36 may surround the dip tube 26 to create an annular passage 38 through which the untreated synthetic gas may rise. The draft tube 36 is typically concentrically placed outside the lower part of the dip tube 26 and may be supported at the bottom of the pressure vessel 2. In further embodiments, a spray quench system 40 may be used to help cool the untreated synthetic gas.

The synthetic gas outlet 30 may generally be located separate from and above the quench chamber sump 28 and may be used to transfer the untreated synthetic gas and any water to, for instance, one or more treatment units 33. The treatment units may include, but are not limited to, a soot removal unit, a water treatment unit, and/or a treatment unit. For example, the soot removal unit may remove fine solid particles and other contaminants. The treatment units, such as a scrubber, may remove entrained water from the untreated synthetic gas, which may then be used as quench water within the quench chamber 14 of the gasifier 10. The treated synthetic gas from the gas scrubber unit may ultimately be directed to a chemical process or a combustor of a gas turbine engine, for example.

Figure 2A:
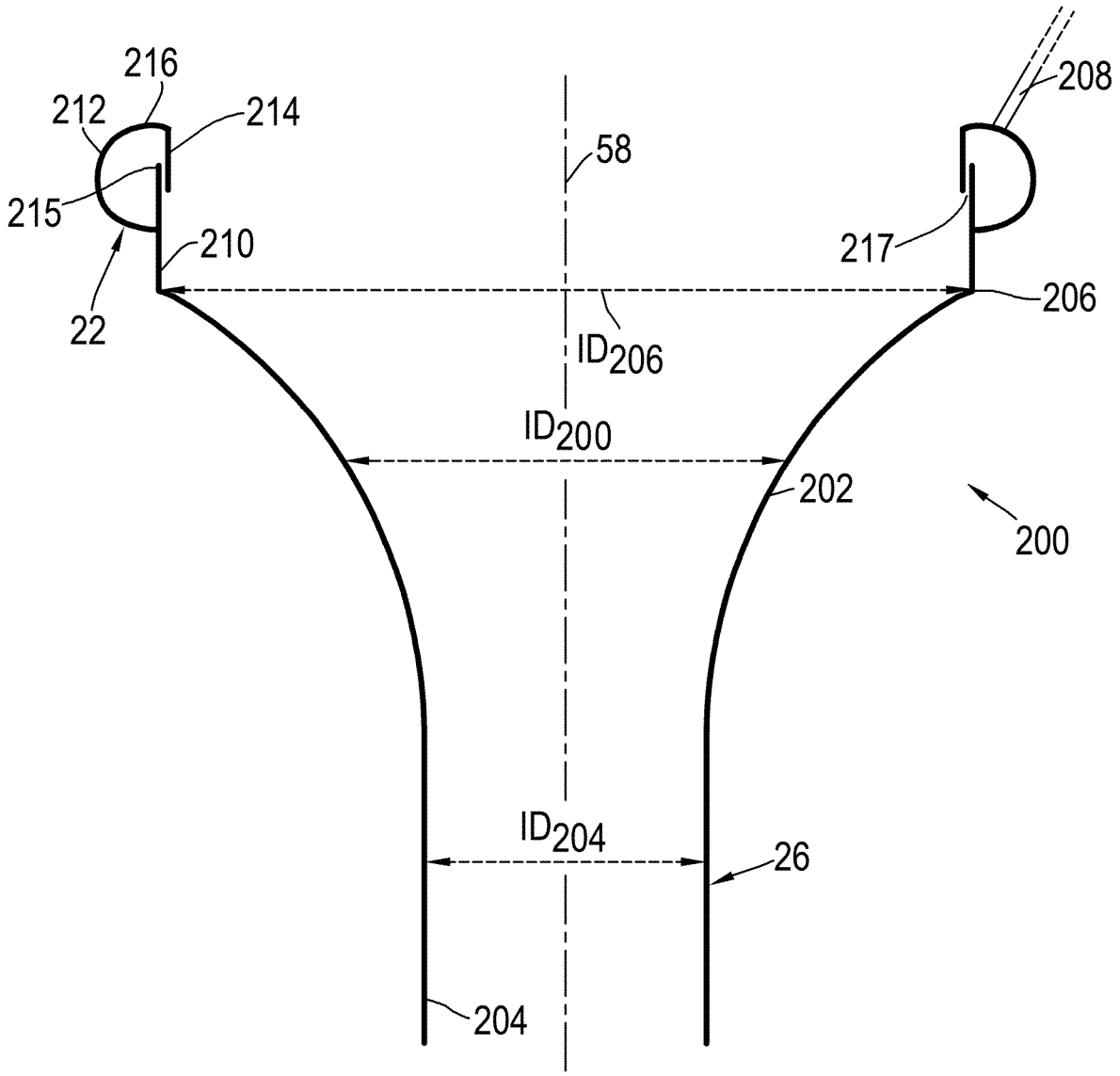
FIG. 2A shows a diagrammatical sectional view of an embodiment of an intermediate section of the gasifier.

FIG. 2A shows an embodiment of the intermediate section 11 according to the present disclosure. The diptube 26 is provided with a widened top section 200. The top section 200 has an inner diameter $ID_{200}$ exceeding the inner diameter $ID_{204}$ of the middle section 204 of the dip tube 26. The section 204 may extend all the way to the water bath, thus also forming a lower section. The upper diptube section 200 may, for instance, be flared or trumpet shaped. The upper section 200 may, for instance, comprise a curved section 202, being curved in cross section as shown in FIG. 2A. The curved section 202 may be connected to a cylindrical section 204 of the dip tube.

The trumpet shape, as shown in FIG. 2, may indicate that the diameter $ID_{200}$ continuously increases along at least part of the top section 200. The diameter $ID_{200}$ may increase continuously towards an upper edge 206 of the upper section. Preferably, at least part of the top section 200 encloses the metal floor 54 at the syngas outlet 52. The upper edge 206 has indicated inner diameter $ID_{206}$.

The quench ring 22 may be arranged at the upper end 206 of the widened top section 200. The quench ring is connected to a supply line 208 for cooling fluid, typically water. Preferably, the quench ring encloses the outer surface of the syngas outlet 52.

Figure 3:
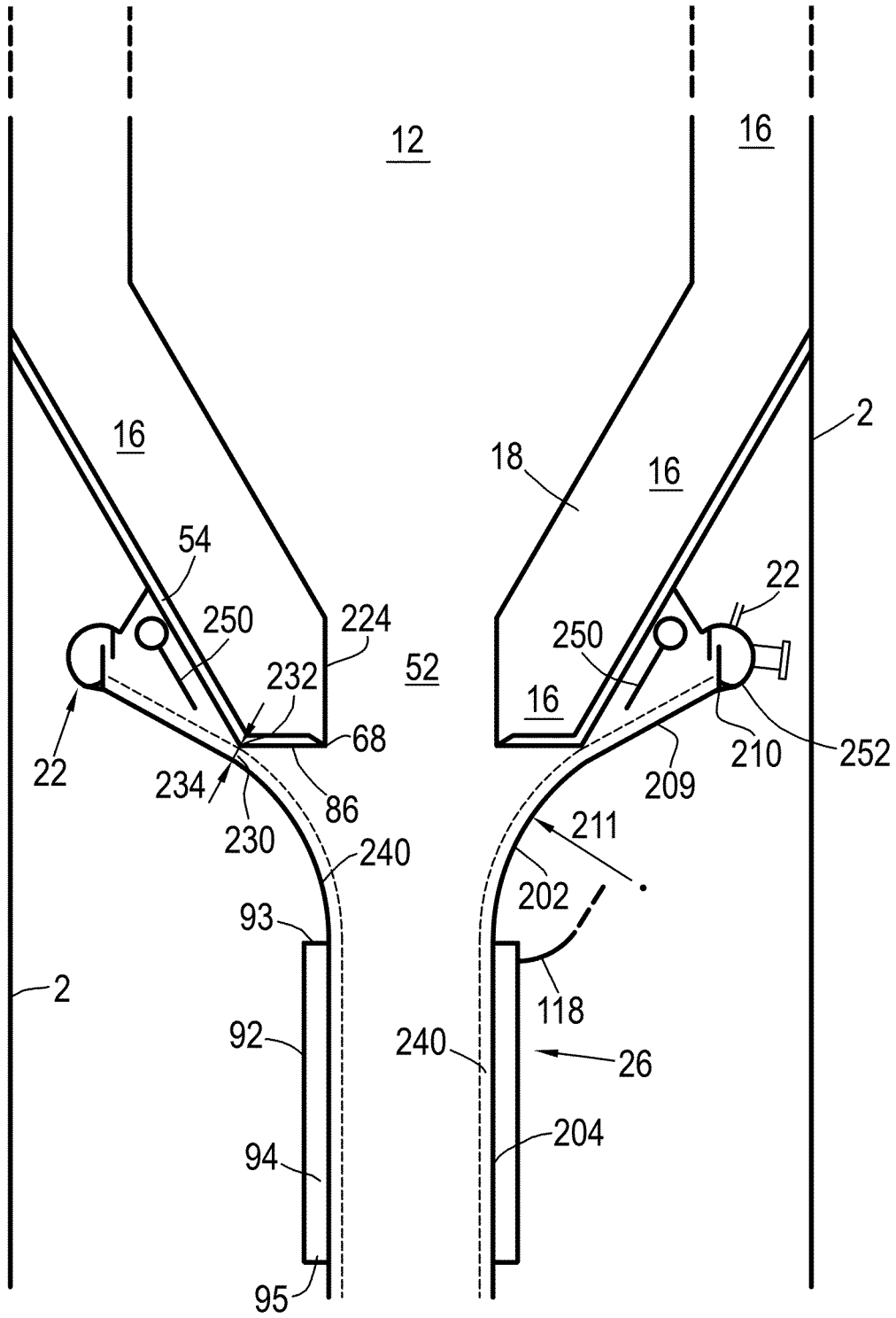
FIG. 3 shows a diagrammatical sectional view of another embodiment of the intermediate section of the gasifier.

In an embodiment, the quench ring may comprise a wall section 210. The wall section 210 may be connected to the upper end 206 of the dip tube. The wall section 210 may be vertical (FIG. 2A), or (slightly) slanted with respect to the vertical (FIG. 3). In addition, the quench ring may comprise a tubular fluid container 212 enclosing the wall section 210. The fluid container may comprise a lip 214 enclosing a top edge 215 of the wall section 210, creating a slit 217 therebetween which provides sufficient space between the lip and the top of the wall 210 to allow passage of cooling fluid.

Figure 2B:
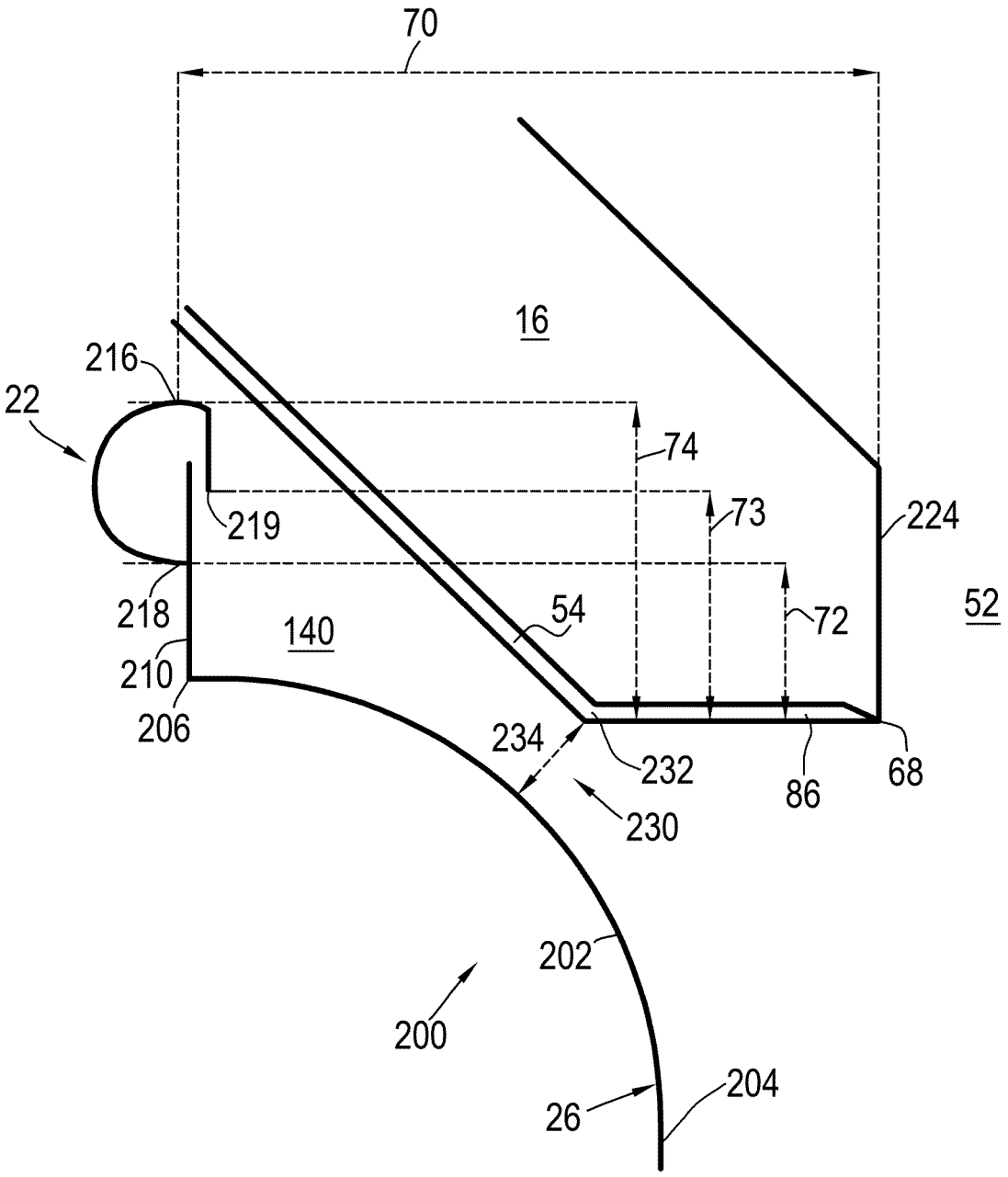
FIG. 2B shows a detail of the embodiment of FIG. 2A.

As indicated in FIG. 2B, a lower end 218 of the quench ring may be arranged at a distance 72 above the lower end 68 of the syngas outlet 52. An upper end 216 of the quench ring is at a distance 74 above the lower end 68. A lower edge 219 of the lip 214 may be located a distance 73 above the lower end 68 of the syngas outlet. The quench ring is thus shielded from the syngas by, at least, a horizontal distance 70, a vertical distance, and shielded by the protective barrier 16 and floor 54 of the syngas outlet 52.

The top section 200 of the diptube is arranged at a minimum distance 234 with respect to the gasifier floor 54, leaving a gap 230.

The quench ring may be adapted, for instance, to provide the cooling fluid to the vertical wall section 210 or directly onto the curved section 202.

Referring to FIG. 3, the dip tube may comprise a cylindrical mid section 204. A top section 200 is connected to the mid section 204. A curved section 202 is provided on top of the mid section, having a curvature radius 211. A straight section 209 may be provided at an upper end of the curved section 202.

FIG. 2B schematically indicates distances between respective elements of the intermediate section 11. FIG. 2B shows the quench ring 22 arranged at a horizontal distance 70 with respect to the inner surface 224 of the syngas outlet 52. The lower end 218 of the quench ring 22 is arranged at a vertical distance 72 above the lower end 68 of the outlet 52. The upper end 216 of the quench ring 22 is at a distance 74 to the lower end 68 of the outlet 52.

FIGS. 2B and 3 also indicates a gap 230 between the top section 200 of the dip tube and the floor 54 of the reactor 12. A minimum distance 234 of said gap 230 is for instance located between the wall of the dip tube and an intersection 232 of the floor sections 54 and 86.

Referring to FIG. 2B, the horizontal distance 70 and vertical distances 72, 74 allow a space 140 between the dip tube and the outer surface of the syngas outlet 52 and/or the outer surface of the reactor floor 54. The space 140 is relatively cool, due to radiative cooling from the cooling fluid film 240, provided by the quench ring 22 (FIG. 3). As the thickness of the fluid film 240 increases towards the middle section 204 of the diptube due to the decreasing inner diameter of the upper diptube section 200, the cooling effect provided by the fluid film also increases.

In addition, due to the limited space provided by the gap 230, circulation of hot syngas exiting the outlet 52 towards the space 140 is limited.

Optionally, making the inner diameter $ID_{204}$ of the diptube section 204 substantially similar to the inner diameter $ID_{52}$ of the syngas outlet may further limit recirculation of syngas.

The enclosed space 140 may furthermore be closed at its upper end, for instance by sealing plate 114, limiting gas circulation in the space 140, limiting entrance of hot syngas through the gap 230.

Figure 5:
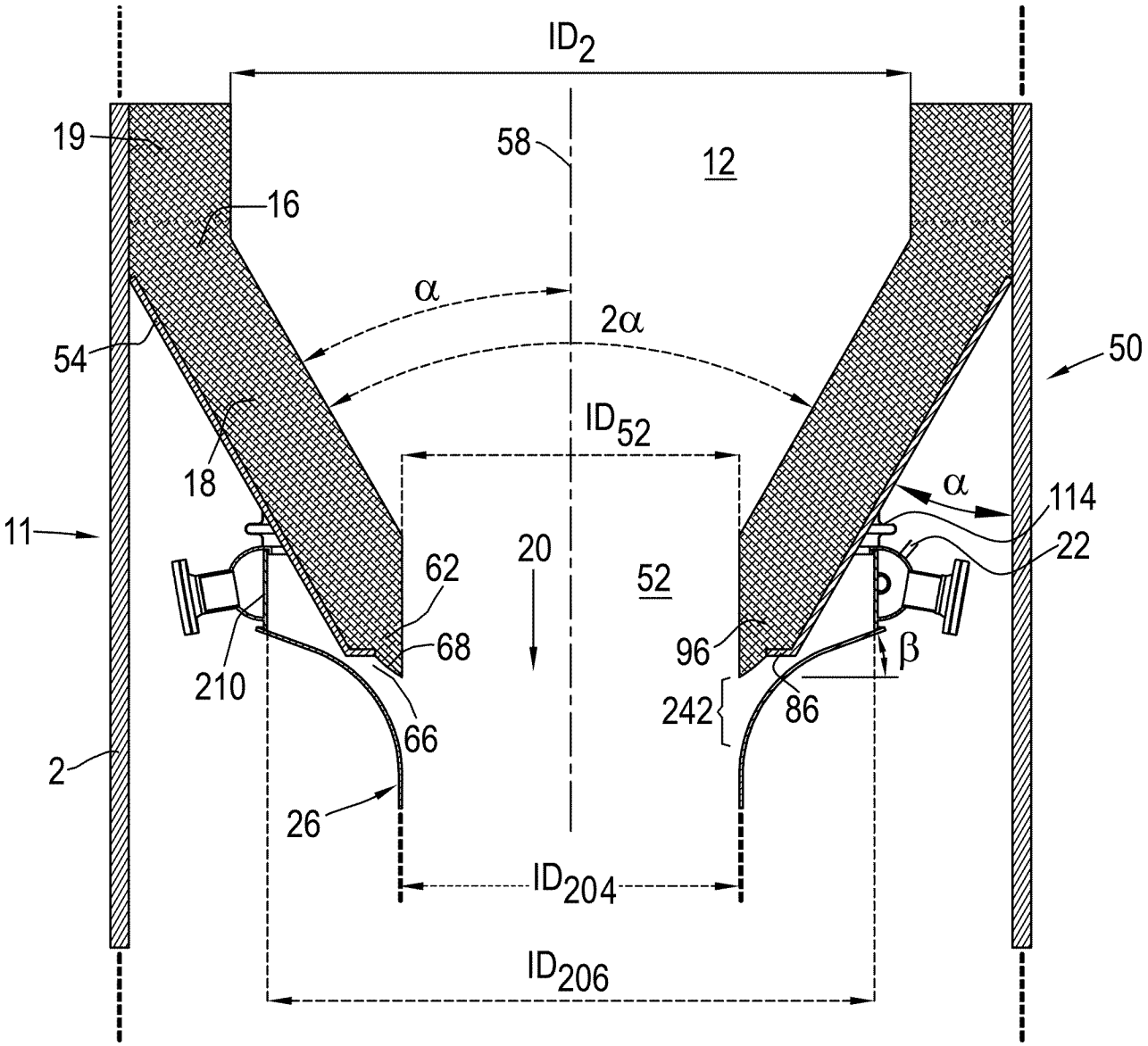
FIG. 5 shows a sectional view of the embodiment of FIG. 4.

The embodiments of the present disclosure limit the interruption 242 between the inner surface of the syngas outlet 52 and the diptube. In the interruption 242, circulation of syngas towards the area 140 is limited by the coanda effect, which draws the syngas flow towards the wall of the diptube, and to the downflowing cooling liquid film 240. The design and shape of the upper section 200 of the diptube can be optimized to maximize this effect. The diptube design as shown in FIG. 5 may represent an optimization of this effect. Herein, the cilindrical inner surface of the syngas outlet substantially continues in the cilindrical inner surface of the diptube section 204, having substantially the same inner diameter and leaving only a minimal interruption 242 therebetween.

The quench ring is located at a distance above the lower edge 68 of the syngas outlet 52. The quench ring is thus kept relatively cool during operation, being shielded from hot syngas, as well as from slag and ash. This reduces wear and corrosion of the quench ring, and significantly increases the lifespan. Parts exposed to the hot syngas, such as the middle part 204 of the dip tube, can be cooled by the cooling fluid film 240, limiting wear.

The inner surface of the outlet 52 is protected by a layer of protective barrier, having a predetermined thickness. Potential leakage of syngas through interfaces between refractory bricks of the protective barrier 16 at or near the outlet 52 is blocked by the gas tight floor sections 54, 86. As said floor sections are cooled by radiative cooling from the fluid film 240, the temperature of the metal floor can be limited to a predetermined temperature threshold, thus limiting corrosion of the metal floor. In an preferred embodiment, the temperature of the metal floor 54 can be limited to a predetermined temperature range. The thickness of the fluid film 240 can be adapted by adjusting the fluid supply to the quench ring 22 accordingly.

In the embodiment of FIG. 3, the intermediate section may be provided with one or more optional blast nozzles or purging nozzles 250. The blast nozzles may be arranged in the space 140 between the floor 54 and the quench ring 22. The nozzles 250 may be adapted to blast pressurized purging gas or purging liquid towards, for instance, the gap 230 for removing ash and solids. Purging and cleaning the gap, for instance periodically, may prevent accumulation of soot particles or potential solids accumulation in the gap or on the curved dip tube section 202. The purging nozzles thus can prevent ash from re-circulated syngas blocking the gap between reactor floor and the dip tube.

Alternatively, one or more of the blast nozzles 250 may be directed to an outer surface of the reactor floor 54, 86, or be activated for additional cooling of the reactor floor. Spraying additional cooling fluid onto the metal support floor 54 may prevent overheating of the metal support in case of unwanted ingress of hot syngas.

Second purging nozzles 252 may be directed along, or onto, the end of the dip tube upper edge 206, to remove potential solids accumulation from the quench ring water accumulating on the sloping section 209 of the upper dip tube end 200 and/or near the upper edge 206.

Figure 4:
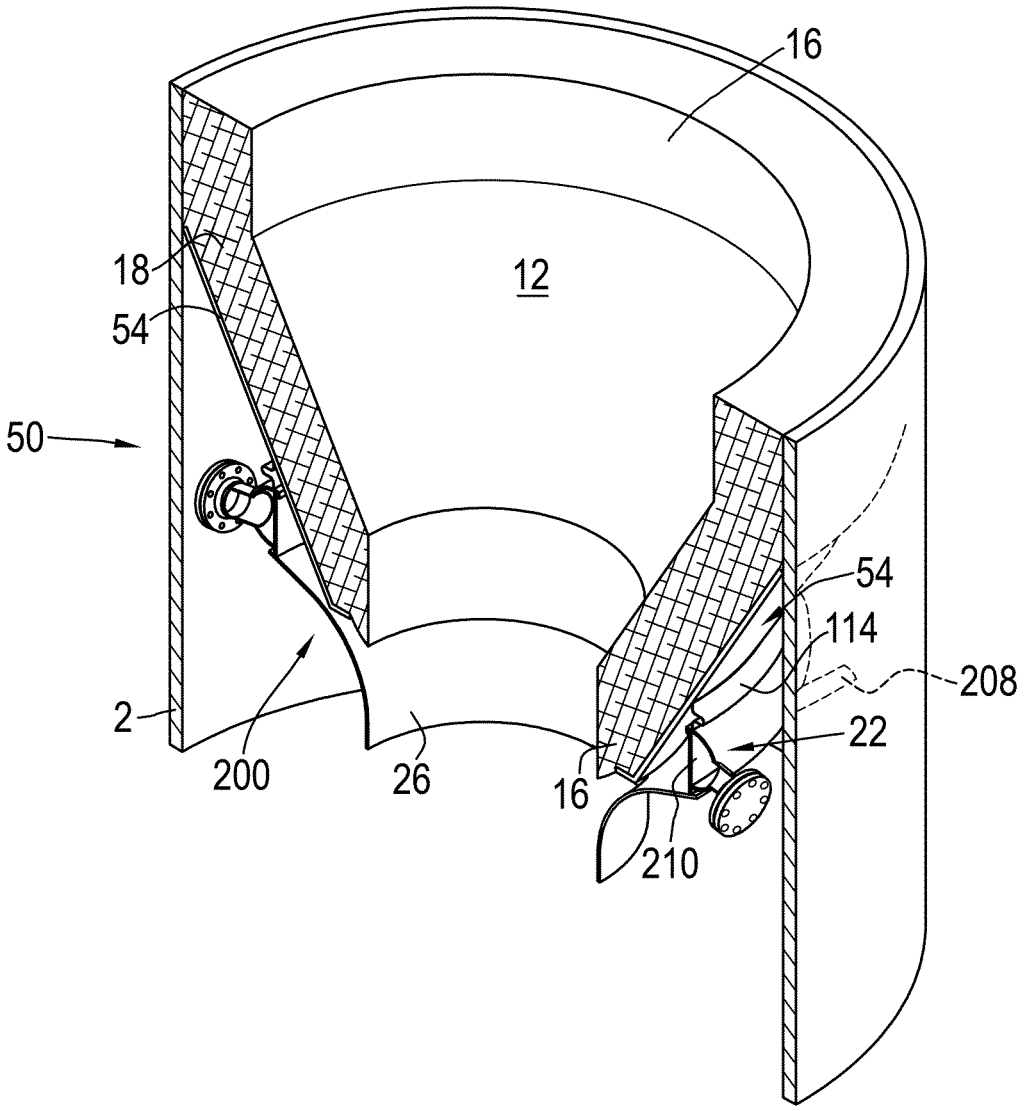
FIG. 4 shows a perspective view of yet another embodiment of the intermediate section of the gasifier.

FIGS. 4 and 5 show an embodiment of the intermediate section 11 of the gasifier. The intermediate section 11 may comprise the reactor floor 50, which may be cone shaped. The reactor floor 50 may end in a reactor outlet 52 at the bottom. The cone shaped reactor floor 50 may have an inner surface, provided at an appropriate angle $\alpha$ (FIG. 5) with respect to the vertical perpendicular line 58 of the reactor, for instance in the range of 30 to 70 degrees, for instance about 60 degrees. The total angle of the cone, i.e. $2\alpha$, may be about 100 to 140 degrees, for instance about 120 degrees.

The protective barrier 16 may comprise layers of refractory bricks or castables. At the reactor floor, the protective barrier 18, for instance comprising refractory bricks, may be supported by a metal floor 54. At the bottom of the conical floor section 54, the floor may comprise a horizontal section 86 to support the lower end section 96 of the protective barrier.

The protective barrier 16 may comprise, for instance, a number of layers of refractory bricks, for instance two or three layers. The lower section 18 of the protective barrier may comprise the same number of layers. The types of bricks of these layers may be identical to the bricks included in a cylindrical middle part 19 of the protective barrier.

At the bottom of the reactor floor, near the syngas opening 52, the protective barrier 16 may define an outlet dimension, such as the inner diameter $ID_{52}$ of the opening 52. The inner diameter of the opening 52 may be substantially constant along its vertical length.

Optionally, a protective liner may be provided to at least part of the bottom of the horizontal wall section and/or to the lower end 62 of the protective barrier 16. The protective liner may provide additional protection against corrosion and potential overheating by the hot syngas. The protective liner may, for instance, comprise a castable refractory material used to create a monolithic lining covering the lower surface of the protective barrier.

There is a wide variety of raw materials that are suitable as refractory castable, including chamotte, andalusite, bauxite, mullite, corundum, tabular alumina, silicon carbide, and both perlite and vermiculite can be used for insulation purposes. A suitable dense castable may be created with high alumina (Al2O3) cement, which can withstand temperatures from 1300° C. to 1800° C.

The castable lining 66 may be monolithic, meaning it lacks joints and thus prevents ingress of syngas, protecting the horizontal floor section 86.

A lower end 68 of the protective barrier, may extend beyond an inner peripheral edge of the horizontal floor section 86 and slope downwardly at an angle $\beta$, in the direction of the syngas flow. The angle $\beta$ may be in the range of 15 to 60 degrees, for instance about 30 degrees or 45 degrees.

Optionally, seals may seal the space 140 from the quench chamber. A seal option comprises a bended or folded sealing plate 114 (FIG. 4). Herein, the fold(s) in the sealing plate 114 can accommodate for differences in expansion coefficients between respective materials. Another option comprises a horizontal sealing plate (not shown), for instance between the top of the quench ring 216 and the floor section 54.

In a preferred embodiment, the water film 240 on the dip tube inner surface provides sufficient cooling by radiative cooling to keep the temperature of the metal floor 54, 86 above the dew point of the syngas, thus preventing dew point corrosion of the metal. For instance, one or more of the following parameters can be adjusted to achieve a predetermined cooling capacity:

- The flux of cooling fluid, as provided by the quench ring, can be adjusted to increase the cooling capacity thereof;
- The temperature of the cooling fluid can be adjusted, for instance reduced to increase the cooling capacity; and/or
- The floor sections 54, 86 and the upper dip tube end can be designed to minimize the mutual distance. For instance, the distance 234 at the gap 230 can be reduced, to increase the radiative cooling of the floor by the cooling fluid film 240.

The distances shown in the figures may be within a preferred range to optimize the advantages described above. Horizontal distance 70 preferably exceeds a predetermined minimum threshold, to ensure optimal shielding of the quench ring and/or to allow easy access to the quench ring for maintenance. The minimum distance 234 of the gap 230 may be limited to an upper threshold, to limit circulation in space 140 and to prevent syngas from recirculating and entering the space 140. The horizontal distance 70 may exceed, for instance, 10 to 15 cm. The horizontal distance may be in the range of 30 to 50 cm.

The vertical distances 72, 74 may exceed a minimum threshold to ensure proper shielding of the quench ring from the hot syngas and corrosive elements therein. The vertical distance 72 may exceed 10 cm, and is for instance at least 15 cm. The vertical distance 74 may exceed 30 cm.

Diameter of the outlet 52 is, for instance, at least 60 cm. The $ID_{52}$ may be in the order of 1 m. The $ID_{204}$ of the middle section 204 of the dip tube may be in the order of $ID_{52}$. Diptube inner diameter $ID_{204}$ may be substantially equal to outlet inner diameter $ID_{52}$, to limit turbulence and recirculation of syngas. The inner diameter $ID_{52}$ has, for instance, a minimum requirement of about 60 cm or more (manhole criterium, i.e. preferably a person should be able to pass through).

The distance 234 of the opening 230 may be in the order of a few cm. The distance 234 may be in the range of about 1 to 5 cm (FIG. 2B, 3).

The radius 211 of the curved section 202 of the diptube may be in the range of 20 to 50 cm. Quench water supplied by the quench ring can flow along the inside surface of the dip tube 26 all the way down to the water bath 28.

As shown in FIG. 3, an optional cooling enclosure may be arranged on the outside of the dip tube. The cooling enclosure comprises, for instance, a cylindrical element 92 with closed upper end 93 and lower end 95, leaving an annular space 94 between the cylinder 92 and the outer surface of the dip tube section 204. Cooling fluid, such as water, may be supplied and circulated through the annular space 94 via cooling fluid supply lines 118. The annulus 94 may have a width in the order of 1 to 10 cm.

The floor sections 54, 86 are connected, and preferably provide a gas-tight barrier to prevent potential leakage of syngas from the reactor 12 to the quench ring 22.

The embodiments of the present disclosure provide a quench ring hidden behind the cone 50, shielded from the hot syngas. The widened upper end of the dip tube provides improved cooling of the middle dip tube section 204. The reducing diameter with a smooth curve from the upper end 206 towards the middle section 204 creates a thickened water film on the inner surface of the dip tube below the upper section 202. The water film on the inner surface of the upper dip tube end 202 provides cooling to the metal floor 54, 86 of the reactor floor, for instance by radiation. In addition, the water film may engage at least a part of the metal floor. The embodiments of the disclosure allow the middle dip tube section to have a reduced inner diameter. The inner diameter of the middle section of the dip tube may for instance be substantially limited to the inner diameter of the syngas outlet. The latter minimizes syngas recirculation, preventing ash and solids accumulation. The $ID_{204}$ may, for instance, be in a range of about 95% to 110% of $ID_{52}$. The $ID_{52}$ of the reactor outlet may be in the range of 0.5 to 1.5 m, for instance about 0.6 to 1 m. The inner diameter $ID_{206}$ of the upper edge 206 may be about 1.5 to 2 m. $ID_{206}$ may exceed the $ID_{52}$ with at least 10 to 50%.

The present disclosure provides an improved intermediate section between the reactor and the quench chamber, wherein the quench ring is located relatively further outward. As a consequence, the quench ring can provide a larger part of the system, such as the inner surface of the dip tube, with a protective and cooling water film. The system of the disclosure thus prevents dry spots on the inner surface of the dip tube, thus preventing corrosion and increasing the lifespan.

The quench ring is located remote from the hot syngas, in an area which is shielded from heat radiation. Additional active cooling elements to cool the quench ring surface and/or the reactor floor can therefore be obviated.

The structure floor, such as part of the conical section 54 and the horizontal section 86 of the metal reactor floor, is likewise protected by the water film on the dip tube inner surface, due to radiant temperature transfer from the film to the metal floor. Thus, active cooling on the metal floor can be obviated as well.

In addition, the embodiments of the disclosure enable an arrangement of the protective barrier 16, wherein the thickness of the protective barrier on top of the metal floor is substantially constant. At least, significant steps, or stepwise changes, in the cross section between the metal parts, such as the reactor floor 54, and the reactor facing surface of the barrier 16 can be obviated. As a result, the disclosure enables:

- An optimized flow pattern of the syngas in the reactor and through the reactor outlet. This includes limited recirculation of syngas and limited turbulence;
- A limitation, or minimization, of surfaces for deposition of ash, fouling, and solids;
- Minimization of the volume of the quench chamber. The gasifier can be shorter which limits costs (CAPEX);
- To arrange the quench ring at location which is relatively accessible. The accessible location simplifies maintenance, and consequently limits downtime and operational expenditure. The quench ring can be located at a position of the quench chamber with relatively a lot of space available, and can be accessed via a relatively spacious part of the quench chamber;
- A combination of quench ring and optional, additional dip tube cooling system. The additional dip tube cooling system may, for instance, comprise a cylindrical element enclosing part of the outer surface of the dip tube, for instance at the middle part 204;
- An extended lifespan and enhanced reliability (or reduced susceptibility to breakdown and failure) of the gasification system; and
- Minimization of cooling equipment to protect and cool the metal support floor of the gasifier floor.

The simple setup limits costs for equipment as well as for maintenance.

In a practical embodiment, the temperature in the reactor chamber may typically be in the range of 1300 to 1700° C. When using a fluid carbonaceous feedstock comprising heavy oil and/or oil residue, the temperature in the reactor is, for instance, in the range of 1300 to 1400° C. The pressure in the reactor chamber may be in the range of 25 to 70 barg, for instance about 50 to 65 barg.

The present disclosure is not limited to the embodiments as described above, wherein many modifications are conceivable within the scope of the appended claims. Features of respective embodiments may for instance be combined.

The invention claimed is:

1. A gasification system for the partial oxidation of a carbonaceous feedstock configured to at least provide a synthesis gas, the system comprising:

- a reactor chamber for receiving and partially oxidizing the carbonaceous feedstock;
- a quench chamber below the reactor chamber for holding a bath of liquid coolant; and an intermediate section connecting the reactor chamber to the quench chamber, the intermediate section comprising:

a reactor chamber floor provided with a reactor outlet opening through which the reactor chamber communicates with the quench chamber to conduct the synthesis gas from the reactor chamber into the bath of the quench chamber;

at least one layer of refractory bricks enclosing the reactor outlet opening;

a dip tube extending from the reactor outlet opening to the bath of the quench chamber, the dip tube having a widened top section, the widened top section comprising a curved section that extends to a middle section of the dip tube so that an inner diameter of the dip tube increases from the middle section to the widened top section, and wherein the widened top section further comprises a quench ring configured to provide liquid coolant to an inner surface of the dip tube, the quench ring having a fluid container and a vertically extending wall section, the fluid container in communication with a slit defined by a lip enclosing a top edge of the wall section such that the wall section extends below the slit and the liquid coolant is flowable from the fluid container to the wall section via the slit;

an upper end of the widened top section of the dip tube connected to the wall section of the quench ring so that the liquid coolant is flowable along the curved section of the dip tube to form a cooling liquid film that extends from adjacent the reactor outlet opening to a middle section of the dip tube so that a thickness of the cooling liquid film increases as the liquid cooling film extends from adjacent the widened top section of the dip tube to the middle section of the dip tube to provide an increasing cooling effect.

2. The gasification system of claim 1, the widened top section of the dip tube enclosing an outer surface of the reactor outlet opening.

3. The gasification system of claim 1, wherein a lower end of the quench ring is positioned at a distance above a lower end of the reactor outlet opening.

4. The gasification system of claim 1, the quench ring being arranged at a horizontal distance with respect to an inner surface of the reactor outlet opening.

5. The gasification system of claim 1, comprising a seal for sealing a space between the quench ring and the reactor chamber floor.

6. The gasification system of claim 1, the reactor chamber floor comprising:

a conical section and a horizontal section connected to the conical section at an intersection; and the widened top section of the dip tube defining a gap between the dip tube and the reactor chamber floor.

7. The gasification system of claim 6, a minimum distance of said gap being located between a wall of the widened top section of the dip tube and the reactor chamber floor.

8. The gasification system of claim 7, the minimum distance being 5 cm or less.

9. The gasification system of claim 6, comprising at least one blast nozzle directed to the gap between the dip tube and the reactor chamber floor for cleaning or purging thereof.

10. The gasification system of claim 1, wherein the middle section of the dip tube is a cylindrical middle section connected to the widened top section, the inner diameter at the middle section being substantially equal to an inner diameter of the reactor outlet opening.

11. The gasification system of claim 10, the middle section of the dip tube being provided with a cooling enclosure on an outside of the middle section.

12. The gasification system of claim 11, the cooling enclosure comprising a cylindrical element with closed upper end and closed lower end, leaving an annular space between the cylindrical element and an outer diameter of the middle section of the dip tube for circulating cooling fluid.

13. The gasification system of claim 1, wherein the carbonaceous feedstock is a liquid feedstock comprising, at least, oil or heavy oil residue.

14. A gasification process for the partial oxidation of a carbonaceous feedstock to at least provide a synthesis gas, comprising:

gasifying the carbonaceous feedstock in the a gasification system according to claim 1 to provide the synthesis gas.

15. A gasification system configured to at least provide a synthesis gas from a carbonaceous feedstock, the system comprising:

a reactor chamber for receiving and partially oxidizing the carbonaceous feedstock;

a quench chamber below the reactor chamber for holding a bath of liquid coolant; and an intermediate section connecting the reactor chamber to the quench chamber, the intermediate section comprising:

a reactor chamber floor provided with a reactor outlet opening through which the reactor chamber communicates with the quench chamber to conduct the synthesis gas from the reactor chamber into the bath of the quench chamber, a dip tube extending from adjacent the reactor outlet opening to the bath of the quench chamber, and a quench ring configured to provide liquid coolant to an inner surface of the dip tube, the quench ring positioned at an upper edge of the dip tube, the quench ring having a fluid container and a vertically extending wall section, the fluid container in communication with a slit defined by a lip enclosing a top edge of the wall section such that the wall section extends below the slit and the liquid coolant is flowable from the fluid container to the wall section via the slit; and the dip tube having an upper curved section extending from the upper edge of the dip tube to a mid section of the dip tube such that an inner diameter of the dip tube increases from the mid section of the dip tube to the upper edge of the dip tube, the upper edge of the dip tube connected to a lower edge of the wall section of the quench ring such that the liquid coolant from the quench ring flows to the dip tube to form a cooling liquid film along an inner surface of the dip tube defining the inner diameter of the dip tube, the wall section of the quench ring and the upper edge of the dip tube being connected such that the cooling liquid film increases in thickness as the cooling liquid film extends from the upper edge of the dip tube to the mid section of the dip tube so that a portion of the cooling liquid film at the mid section of the dip tube provides a greater cooling effect than a portion of the cooling liquid film adjacent the reactor outlet opening.

16. The gasification system of claim 15, comprising:

at least one blast nozzle positioned between the reactor chamber floor and the quench ring to feed pressurized fluid to a gap between a top section of the dip tube and the reactor chamber floor to prevent accumulation of solid particulates in the gap to prevent the gap from being blocked.

17. The gasification system of claim 16, comprising:

a sealing plate positioned between the reactor chamber floor and the quench ring to seal a space in fluid communication with the gap.

18. The gasification system of claim 17, wherein the inner diameter of the dip tube at the mid section of the dip tube is equal to an inner diameter of the reactor outlet opening to limit turbulence and recirculation of synthesis gas.

* * * * *